US008905509B2

(12) United States Patent
Fujimoto

(10) Patent No.: US 8,905,509 B2
(45) Date of Patent: Dec. 9, 2014

(54) PRINTING APPARATUS

(71) Applicant: Riso Kagaku Corporation, Tokyo (JP)

(72) Inventor: Masatoshi Fujimoto, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/044,810

(22) Filed: Oct. 2, 2013

(65) Prior Publication Data

US 2014/0098154 A1 Apr. 10, 2014

(30) Foreign Application Priority Data

Oct. 4, 2012 (JP) ..... 2012-222028

(51) Int. Cl.
*B41J 29/38* (2006.01)

(52) U.S. Cl.
USPC ..... 347/16; 347/14; 358/1.12

(58) Field of Classification Search
USPC ..... 347/5, 9, 16, 14, 19; 358/1.12
IPC ..... B41J 17/02
See application file for complete search history.

(56) References Cited

U.S. PATENT DOCUMENTS

2011/0058207 A1* 3/2011 Morishita ..... 358/1.14

FOREIGN PATENT DOCUMENTS

| | | | |
|---|---|---|---|
| JP | 2588894 | B2 | 3/1997 |
| JP | 63-300247 | A | 12/1998 |
| JP | 2006-089218 | A | 4/2006 |
| JP | 4465602 | B2 | 5/2010 |

* cited by examiner

*Primary Examiner* — Lam S Nguyen
(74) *Attorney, Agent, or Firm* — Studebaker & Brackett PC

(57) ABSTRACT

A printing section for performing duplex printing by performing printing on each printing paper sheet fed by a feeding section and performing printing on the other side of the one-side printed printing paper sheet that has been inverted by an inverting section; a control section for exert control to alternately perform the printing on each printing paper sheet from the feeding section and the printing on each one-side printed printing paper sheet; a post-processing time obtaining section for obtaining a post-processing time for each duplex printed printing paper sheet; and a feeding timing setting section for setting a feeding interval of the printing paper sheets from the feeding section based on the post-processing time for each duplex printed printing paper sheet, and calculating a paper spacing interval between each printing paper sheet from the feeding section and each one-side printed printing paper sheet based on the post-processing time.

4 Claims, 6 Drawing Sheets

DUPLEX PRINTING WITHOUT POST-PROCESSING

SIMPLEX PRINTING WITH POST-PROCESSING

DUPLEX PRINTING WITH POST-PROCESSING WHERE POST-PROCESSING TIMES FOR INDIVIDUAL PRINTING PAPER SHEETS ARE THE SAME

DUPLEX PRINTING WITH POST-PROCESSING WHERE POST-PROCESSING TIMES FOR INDIVIDUAL PRINTING PAPER SHEETS ARE DIFFERENT

PRINTING APPARATUS

BACKGROUND OF THE INVENTION

1. Field of the Invention

The present invention relates to a printing apparatus to which a post-processing unit is connected, and in particular to paper feed control for controlling feeding of printing paper sheets in the printing apparatus.

2. Description of the Related Art

In recent years, printing systems including a post-processing unit, which is connected downstream a printing apparatus to perform various types of post-processing on printed printing paper sheets having subjected to printing at the printing apparatus, have been proposed. Examples of the post-processing performed by the post-processing unit may include stapling, punching, etc.

When post-processing is performed on printed printing paper sheets with this type of printing systems, the post-processing unit requires a time depending on the content of the post-processing. Therefore, when each printed printing paper sheet is passed from the printing apparatus to the post-processing unit, it is necessary to set the time depending on the content of the post-processing. However, if an excessively long time is set for passing each printed printing paper sheet from the printing apparatus to the post-processing unit, productivity may be lowered.

On the other hand, as the above-described printing apparatus with a post-processing unit connected thereto, a printing apparatus that is capable of duplex printing may be used. As the printing apparatus that is capable of duplex printing, for example, printing apparatuses where printing is performed on one side of each printing paper sheet fed from a paper feeding section of the printing apparatus, the one side printed printing paper sheet is inverted by an inverting section, and then printing is performed on the other side of the inverted one side printed printing paper sheet to achieve duplex printing have been proposed.

In order to improve productivity of this type of printing apparatuses for performing duplex printing, a method has been proposed where each one side printed printing paper sheet that has been inverted by the inverting section is inserted between printing paper sheets fed from the paper feeding section. Namely, when duplex printing is performed, a paper feeding time Tp for one printing paper sheet and a paper spacing interval Tg are set between the first printing paper sheet and the second printing paper sheet fed from the paper feeding section, and a one side printed printing paper sheet that has been inverted by the inverting section is inserted at a position corresponding to the paper feeding time Tp, as shown in FIG. 4.

SUMMARY OF THE INVENTION

In the case where a post-processing unit for performing post-processing is connected to a printing apparatus that performs duplex printing and the paper feed control as shown in FIG. 4 is exerted, it is also necessary to perform the paper feed control with taking a time taken for post-processing into account, as described above.

The feeding interval between the printed printing paper sheets passed from the printing apparatus to the post-processing unit is equal to the paper feeding interval Tb shown in FIG. 4. Therefore, for example, if the time taken for the post-processing is longer than the paper feeding interval Tb shown in FIG. 4, one may consider changing the paper feeding interval into a paper feeding interval Td1, as shown in FIG. 12, that is an integer multiple of the paper feeding interval Tb shown in FIG. 4.

However, in the case where the paper feeding interval is changed into an integer multiple of the paper feeding interval Tb, as described above, there may result a large difference between the changed paper feeding interval and the time taken for the post-processing, and this results in lower productivity.

Japanese Patent No. 2588894 (hereinafter, Patent Document 1) discloses controlling the paper feeding interval during duplex printing; however, it proposes nothing about paper feed control that takes the time taken for post-processing, as described above, into account.

Japanese Patent No. 4465602 (hereinafter, Patent Document 2) proposes obtaining a time taken for post-processing at a post-processing unit as a paper output interval, obtaining a difference between a first paper output time from a point of time at which printing is performed on a preceding printing paper sheet to a point of time at which the preceding printing paper sheet is outputted to the post-processing unit and a second paper output time from a point of time at which printing is performed on the following printing paper sheet to a point of time at which the following printing paper sheet is outputted to the post-processing unit, and controlling paper feeding timing of the preceding printing paper sheet and the following printing paper sheet based on a corrected interval that is obtained by correcting the paper output interval for the difference. However, with respect to the above-described paper feed control method where the feeding of each printing paper sheet from the paper feeding section and the feeding of each one side printed printing paper sheet from the inverting section are alternately performed, Patent Document 2 proposes nothing about a method for controlling the paper feed with taking the time taken for the post-processing into account so as not to lower the productivity.

In view of the above-described circumstances, the present invention is directed to providing a printing apparatus that performs duplex printing with alternately performing feeding of each printing paper sheet from a paper feeding section and feeding of each one side printed printing paper sheet from an inverting section, as described above, wherein paper feed control is performed with taking a time taken for post-processing into account so as not to lower the productivity.

An aspect of the printing apparatus of the invention is a printing apparatus including: a paper feeding section for feeding printing paper sheets one by one; a printing section for performing duplex printing by performing printing on one side of each printing paper sheet fed by the paper feeding section, and, after the one side printed printing paper sheet is inverted by an inverting section, performing printing on the other side of the inverted one side printed printing paper sheet; a control section for controlling the paper feeding section and the printing section such that, when the printing section performs the duplex printing, the printing on the one side of each printing paper sheet fed from the paper feeding section and the printing on the other side of each one side printed printing paper sheet are alternately performed; a post-processing time obtaining section for obtaining a post-processing time for each duplex printed printing paper sheet taken for post-processing to be performed on the duplex printed printing paper sheets at a post-processing unit connected downstream the printing section; and a paper feeding timing setting section for setting a paper feeding interval of the printing paper sheets fed from the paper feeding section based on the post-processing time for each duplex printed printing paper sheet obtained by the post-processing time obtaining section, and setting paper feeding timing of the one side printed printing paper sheets based on a paper spacing interval between each printing paper sheet fed from the paper feeding section and each one side printed printing paper sheet, the paper spacing interval being calculated based on the post-processing time for each duplex printed printing paper sheet.

In the printing apparatus of the invention, if at least two of the post-processing times for the individual duplex printed printing paper sheets obtained by the post-processing time obtaining section are different from one another, the paper feeding timing setting section may calculate the paper spacing interval corresponding to each post-processing time based on the post-processing times different from one another, may select, from the calculated paper spacing intervals, the paper spacing interval that results in a minimum sum of differences between each of the paper feeding intervals calculated using each paper spacing interval and the post-processing time corresponding to the paper feeding interval, and may set the paper feeding timing of the printing paper sheets fed from the paper feeding section and the one side printed printing paper sheets based on the selected paper spacing interval.

Further, if all the post-processing times for the individual duplex printed printing paper sheets obtained by the post-processing time obtaining section are the same, the paper feeding timing setting section may set the post-processing time as the paper feeding interval of the printing paper sheets fed from the paper feeding section, and may set the paper spacing interval based on the post-processing time.

Still further, the post-processing time obtaining section may obtain the post-processing time that is stored in advance in the post-processing unit.

According to the printing apparatus of the invention, a printing apparatus that performs duplex printing by performing printing on one side of each printing paper sheet fed by the paper feeding section, and, after the one side printed printing paper sheet is inverted by an inverting section, performing printing on the other side of the inverted one side printed printing paper sheet, where the printing on the one side of each printing paper sheet fed from the paper feeding section and the printing on the other side of each one side printed printing paper sheet are alternately performed, is adapted such that a post-processing time for each duplex printed printing paper sheet taken for post-processing to be performed on the duplex printed printing paper sheets at a post-processing unit connected downstream the printing section is obtained. Then, based on the obtained post-processing time for each duplex printed printing paper sheet, a paper feeding interval of the printing paper sheets fed from the paper feeding section is set, and paper feeding timing of the one side printed printing paper sheets is set based on a paper spacing interval between each printing paper sheet fed from the paper feeding section and each one side printed printing paper sheet, which is calculated based on the post-processing time for each duplex printed printing paper sheet. This allows optimizing the paper spacing interval between each printing paper sheet fed from the paper feeding section and each one side printed printing paper sheet when compared to the above-described method where the paper feeding interval is changed into an integer multiple of the paper feeding interval Tb based on the post-processing time, as shown in FIG. 4, and the productivity can be improved.

Further, in the case where the printing apparatus of the invention is adapted to, if at least two of the post-processing times for the individual duplex printed printing paper sheets obtained by the post-processing time obtaining section are different from one another, calculate the paper spacing interval corresponding to each post-processing time based on the post-processing times different from one another, select, from the calculated paper spacing intervals, the paper spacing interval that results in a minimum sum of differences between each of the paper feeding intervals calculated using each paper spacing interval and the post-processing time corresponding to the paper feeding interval, and set the paper feeding timing of the printing paper sheets fed from the paper feeding section and the one side printed printing paper sheets based on the selected paper spacing interval, a more optimal paper spacing interval can be selected for the different post-processing times for the individual duplex printed printing paper sheets, and the productivity can further be improved.

DESCRIPTION OF THE PREFERRED EMBODIMENTS

Figure 1:
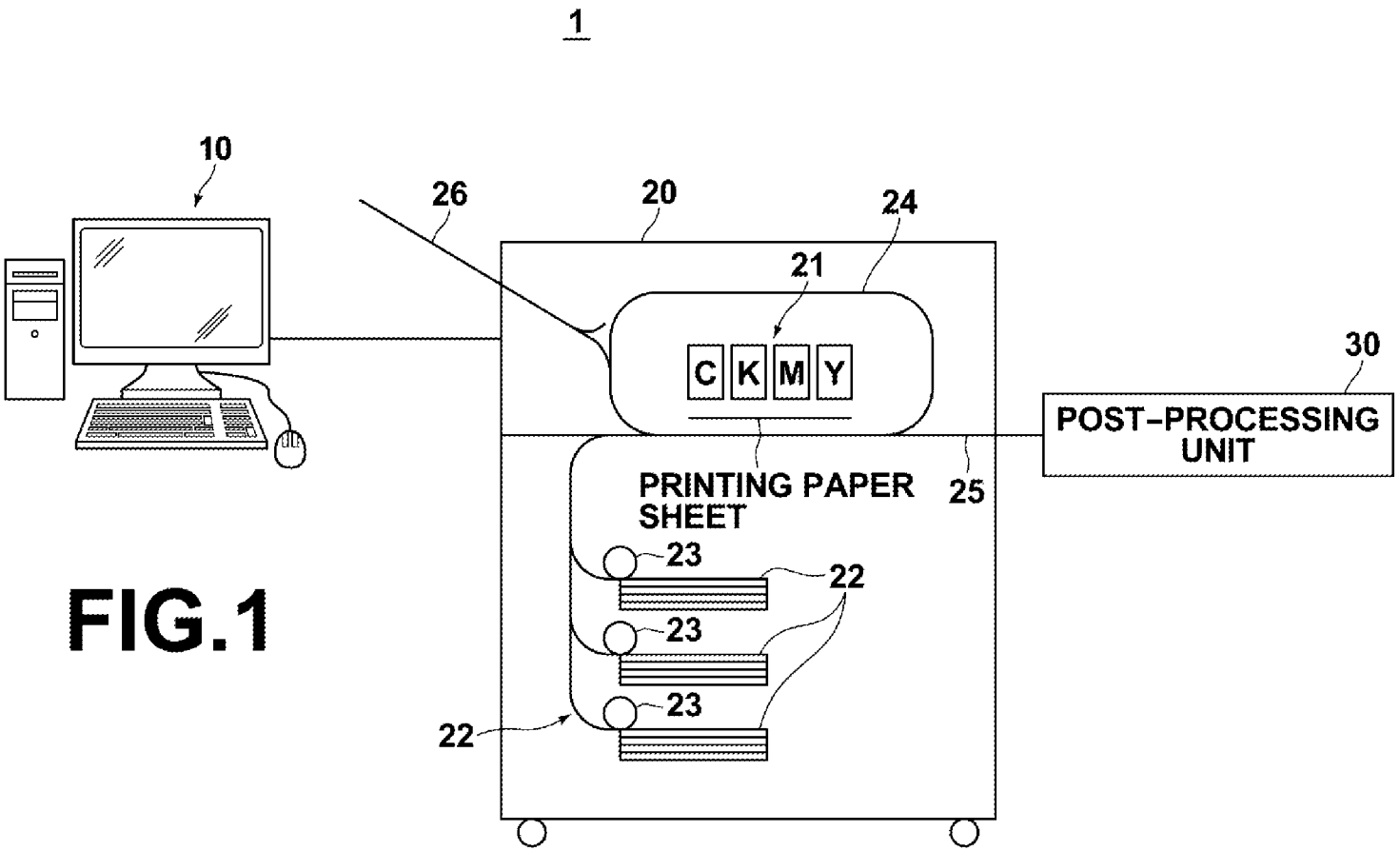
FIG. 1 is a schematic structural diagram of the entire printing system according to one embodiment of the present invention.

Hereinafter, a printing system employing one embodiment of a printing apparatus according to the present invention will be described in detail with reference to the drawings. The printing system of this embodiment is characterized by a method of controlling paper feeding timing in the printing apparatus. First, the entire structure of the system is described. FIG. 1 is a schematic structural diagram of the entire printing system 1 of this embodiment.

As shown in FIG. 1, the printing system 1 of this embodiment includes: a computer 10; a printing unit 20 connected to the computer 10 via a network, such as a wired or wireless LAN; and a post-processing unit 30 for performing post-processing on printing paper sheets having subjected to printing at the printing unit 20.

The computer 10 is configured to be capable of editing image data to be printed on the printing paper sheets. The computer 10 generates print job data including the image data and outputs the print job data to the printing unit 20. The print job data may include, besides the above-described image data, information indicating duplex printing or simplex printing, information of paper size, information of the content of the post-processing, etc.

The printing unit 20 performs printing on the printing paper sheets based on the print job data outputted from the computer 10. The printing unit 20 includes an ink head section 21 for ejecting ink onto each printing paper sheet. The ink head section 21 achieves printing by ejecting ink onto each printing paper sheet based on the image data contained in the print job data which is outputted from the computer 10. The ink head section 21 of this embodiment includes a plurality of line-type ink heads for ejecting inks of different colors, such as black K, cyan C, magenta M and yellow Y.

The printing unit 20 also includes paper feeding trays 22 on which printing paper sheets are placed, and paper feeding section 23 for picking up and feeding the printing paper sheets placed on any of the paper feeding trays 22 one by one. Various types and/or sizes of printing paper sheets are placed on the paper feeding trays 22. When printing is performed at the printing unit 20, the printing paper sheets placed on any of the paper feeding trays 22 are picked up one by one by the paper feeding section 23 provided with pick rollers, or the like, and fed to a circulating conveyance path 24 described below.

The printing unit 20 includes the circulating conveyance path 24 for conveying the printing paper sheets fed by the paper feeding section 23. The circulating conveyance path 24 is formed by conveying rollers, a conveying belt, etc., and conveys each printing paper sheet, which is fed from any of the paper feeding trays 22, from the upstream side to the downstream side of the ink head section 21.

In the case of simplex printing, the circulating conveyance path 24 passes each one side printed printing paper sheet at the ink head section 21 to the post-processing unit 30 via a connecting conveyance path 25. In the case of duplex printing, the circulating conveyance path 24 conveys each one side printed printing paper sheet to an inverting section 26, and conveys the printing paper sheet inverted at the inverting section 26 again from the upstream side to the downstream side of the ink head section 21. Thereafter, the circulating conveyance path 24 passes each printing paper sheet with the other side having subjected to printing at the ink head section 21 (and thus the both sides having subjected to printing) to the post-processing unit 30 via the connecting conveyance path 25. It should be noted that the ink head section 21 and the circulating conveyance path 24 in this embodiment corresponds to a printing section recited in the claims.

The post-processing unit 30 performs predetermined post-processing on the printed printing paper sheets passed from the printing unit 20. Examples of the post-processing performed by the post-processing unit 30 may include stapling to fasten a plurality of printed printing paper sheets with a staple, offset processing to output each set of printed printing paper sheets onto the paper output tray at an offset position from the previous set, punching to punch the printed printing paper sheets, folding to fold the printed printing paper sheets in three, in two, etc, and bookbinding to perform bookbinding using the printed printing paper sheets. As specific mechanisms for performing these types of post-processing, known mechanisms can be used and detailed descriptions thereof are omitted.

Next, a control system of the printing system 1 of this embodiment is described with reference to FIG. 2.

Figure 2:
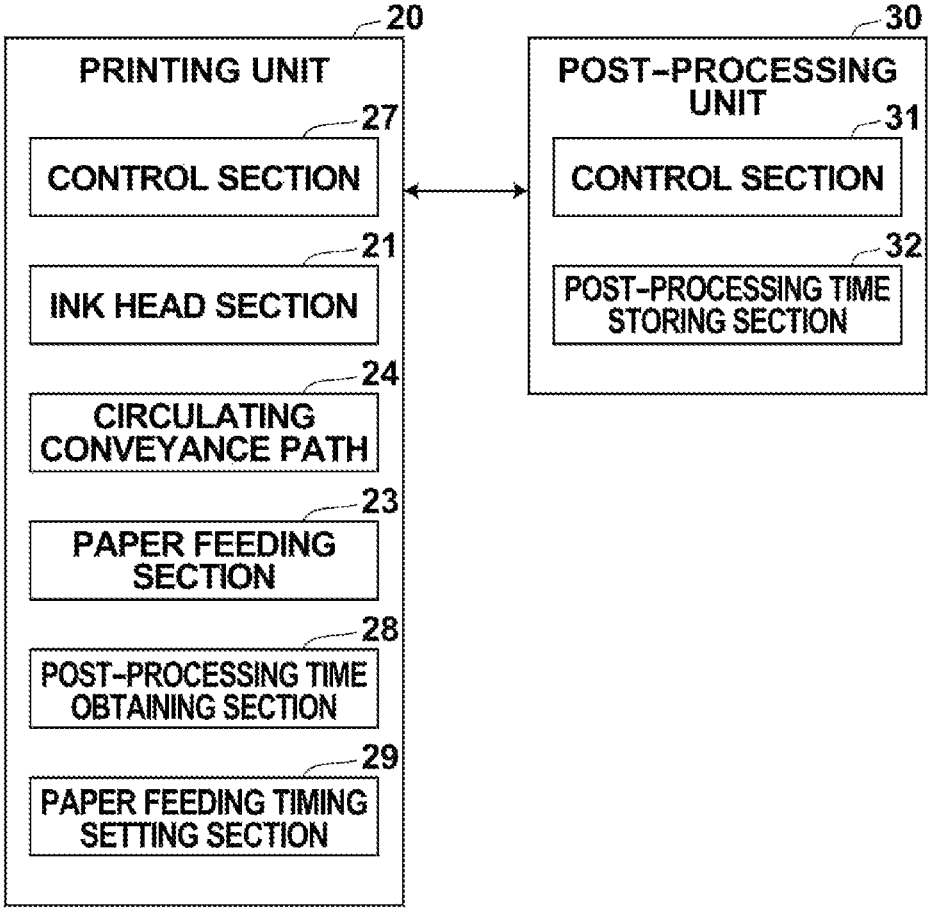
FIG. 2 is a block diagram illustrating part of a control system of the printing system shown in FIG. 1.

As shown in FIG. 2, the printing unit 20 includes a control section 27 for controlling the entire printing unit 20. The control section 27 controls paper feeding timing of the printing paper sheets by the paper feeding section 23, conveyance of the printing paper sheets by the circulating conveyance path 24, ejection of ink from the ink head section 21, etc.

The printing unit 20 also includes: a post-processing time obtaining section 28 for obtaining a post-processing time taken for post-processing to be performed on the printed printing paper sheets outputted from the printing unit 20; and a paper feeding timing setting section 29 for calculating paper feeding timing of the printing paper sheets by the paper feeding section 23 when the post-processing is performed based on the post-processing time obtained by the post-processing time obtaining section 28. The post-processing time obtained by the post-processing time obtaining section 28 is stored in advance in a post-processing time storing section 32 of the post-processing unit 30, which will be described later. The post-processing time stored in advance is read out and outputted from the post-processing unit 30 to the printing unit 20.

How the paper feeding timing is calculated based on the post-processing time by the paper feeding timing setting section 29, and how the paper feed control of feeding of the printing paper sheets from the paper feeding section 23 is performed based on the calculated paper feeding timing will be described in detail later.

The post-processing unit 30 includes a control section 31 for controlling the entire post-processing unit 30, and a post-processing time storing section 32 for storing in advance the time taken for the post-processing at the post-processing unit 30. The post-processing time storing section 32 stores the post-processing time for each printed printing paper sheet received by the post-processing unit 30. For example, in a case where the post-processing is stapling, a different operation is performed at timing when each printed printing paper sheet of a set is received by post-processing unit 30, and therefore a different post-processing time is stored in advance for each printed printing paper sheet. In the case where the post-processing is stapling, the operation to be performed when each printed printing paper sheet is received may include, for examples, three operations including a moving operation for moving an aligning plate, an aligning operation and a stapling operation, and a time taken for each operation is stored correspondingly to each printed printing paper sheet.

On the other hand, in a case where the post-processing is punching, the same operation is performed when each printed printing paper sheet is received by the post-processing unit 30, and therefore the same (common) post-processing time is stored.

The post-processing time stored in the post-processing time storing section 32 for each printed printing paper sheet is outputted to the printing unit 20 and obtained by the post-processing time obtaining section 28 of the printing unit 20.

Next, operation of the printing system 1 of this embodiment is described. As mentioned above, the printing system 1 of this embodiment is characterized by the method of controlling paper feeding timing for feeding the printing paper sheets in the printing unit 20, and therefore this feature is mainly described below.

As described above, the printing system 1 of this embodiment is capable of simplex printing and duplex printing, and is also capable of performing post-processing on each of the simplex or duplex printed printing paper sheets. Namely, the printing system 1 of this embodiment performs printing under one of four printing conditions including "simplex printing without post-processing", "duplex printing without post-processing", "simplex printing with post-processing" and "duplex printing with post-processing". Now, the paper feed control of the printing unit 20 performed under each printing condition is described.

Figure 3:
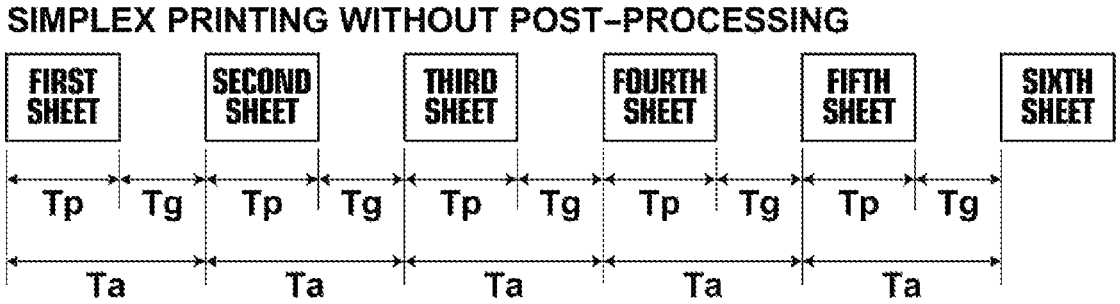
FIG. 3 is a diagram for explaining paper feed control in a case of a printing condition of "simplex printing without post-processing"

First, in the case of the printing condition of "simplex printing without post-processing", the paper feed control is exerted such that the printing paper sheets are fed from the paper feeding section 23 at a paper feeding interval Ta, as shown in FIG. 3. The paper feeding interval Ta is calculated by adding a paper feeding time Tp to a standard paper spacing interval Tg. The paper feeding time Tp is a value obtained by dividing a length of one printing paper sheet in the conveyance direction by a conveying speed of the circulating conveyance path 24. This time is set based on the information of paper size in the print job data. The standard paper spacing interval Tg is a paper spacing interval set in advance. In this embodiment, the standard paper spacing interval Tg is set to 60 ms, which is the minimum interval to avoid collision between the printing paper sheets conveyed by the circulating conveyance path 24.

Figure 4:
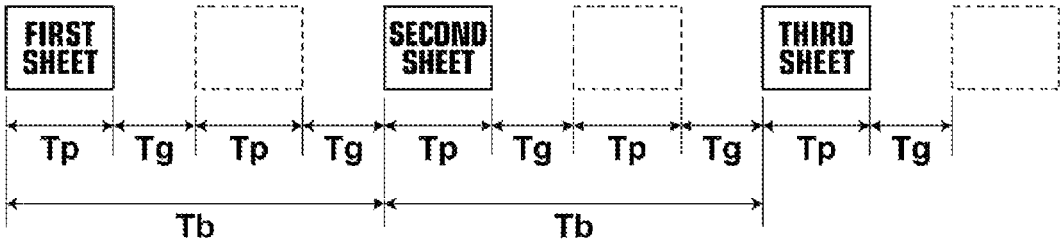
FIG. 4 is a diagram for explaining paper feed control in a case of a printing condition of "duplex printing without post-processing"

Next, in the case of the printing condition of "duplex printing without post-processing", the paper feed control is exerted such that the printing paper sheets are fed from the paper feeding section 23 at a paper feeding interval Tb, as shown in FIG. 4. The paper feeding interval Tb is twice the paper feeding interval Ta of the above-described case of the printing condition of "simplex printing without post-processing". In this case, the paper feeding time Tp for one printing paper sheet and the standard paper spacing interval Tg are set between the printing paper sheets fed from the paper feeding section 23. At a position corresponding to the paper feeding time Tp between the printing paper sheets fed from the paper feeding section 23, each one side printed printing paper sheet that has been inverted by the inverting section 26 of the circulating conveyance path 24 is inserted and conveyed. That is, when duplex printing is performed in this embodiment, feeding of each printing paper sheet that has not yet been subjected to printing from the paper feeding section 23 and feeding of each one side printed printing paper sheet from the inverting section 26 of the circulating conveyance path 24 are alternately performed.

Figure 5:
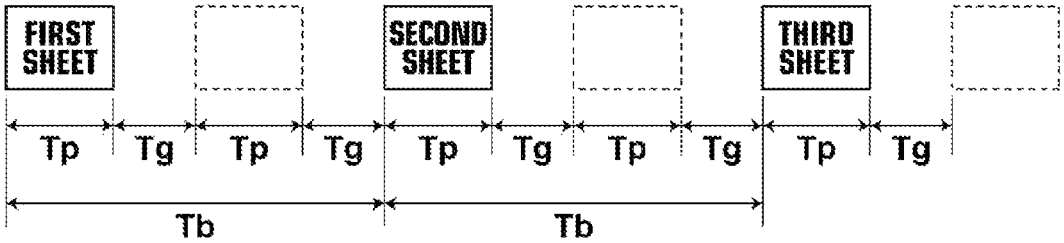
FIG. 5 is a diagram for explaining paper feed control in a case of a printing condition of "simplex printing with post-processing"

Next, in the case of the printing condition of "simplex printing with post-processing", the paper feed control is exerted such that the printing paper sheets are fed from the paper feeding section 23 at a paper feeding interval Tc1, Tc2 or Tc3, as shown in FIG. 5. The paper feeding intervals Tc1 to Tc3 have the same lengths as those of post-processing times Tf1 to Tf3 for the individual printing paper sheets of a set, respectively, i.e., Tc1=Tf1, Tc2=Tf2 and Tc3=Tf3. Specifically, the post-processing times Tf1 to Tf3 for the individual printing paper sheets are read out from the post-processing time storing section 32 of the post-processing unit 30 and outputted to the printing unit 20 to be obtained by the post-processing time obtaining section 28 of the printing unit 20. Then, the post-processing times Tf1 to Tf3 for the individual printing paper sheets obtained by the post-processing time obtaining section 28 are inputted to the paper feeding timing setting section 29, and the paper feeding timing setting section 29 sets the inputted post-processing times Tf1 to Tf3 as the paper feeding intervals Tc1 to Tc3 for the individual printing paper sheets. It should be noted that the post-processing times Tf1 to Tf3 may be the same or different from one another. However, if any of the post-processing times Tf1 to Tf3 is shorter than the paper feeding interval Ta (the paper feeding time Tp+the standard paper spacing interval Tg (60 ms)) of the above-described case of the printing condition of "simplex printing without post-processing", the paper feeding interval corresponding to the post-processing time shorter than the paper feeding interval Ta is set to the same interval as the paper feeding interval Ta.

As described above, in the case of simplex printing, paper spacing intervals Tg'1 to Tg'3 (see FIG. 5) for the individual printing paper sheets can be linearly changed. Therefore, even when the post-processing time for each printing paper sheet varies, a paper feeding interval corresponding to each post-processing time can be set to feed each printing paper sheet.

Next, the paper feed control in the case of the printing condition of "duplex printing with post-processing" is described. In the case of this printing condition, different methods for calculating the paper feeding timing for each printing paper sheet are used in a case where the post-processing times for the individual printing paper sheets are the same and in a case where the post-processing times for the individual printing paper sheets are different.

First, the paper feed control in the case of the printing condition of "duplex printing with post-processing" where the post-processing times for the individual printing paper sheets are the same is described.

Figure 6:
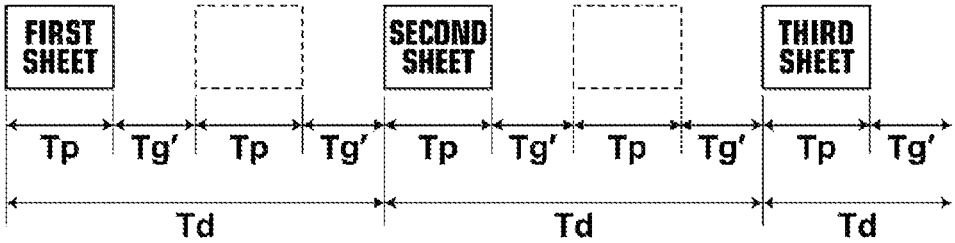
FIG. 6 is a diagram for explaining paper feed control in a case of a printing condition of "duplex printing with post-processing", where post-processing times for individual printed printing paper sheets are the same.

In this case, as shown in FIG. 6, the paper feed control is exerted such that the printing paper sheets are fed from the paper feeding section 23 at a paper feeding interval Td. The paper feeding interval Td has the same length as that of a post-processing time Tf for each printing paper sheet.

As described above, the post-processing time Tf for each printing paper sheet is read out from the post-processing time storing section 32 of the post-processing unit 30 and outputted to the printing unit 20 to be obtained by the post-processing time obtaining section 28 of the printing unit 20. Then, the post-processing time Tf obtained by the post-processing time obtaining section 28 is inputted to the paper feeding timing setting section 29, and the paper feeding timing setting section 29 sets the inputted post-processing time Tf as the paper feeding interval Td for the printing paper sheets fed from the paper feeding section 23.

In the case of the printing condition of "duplex printing with post-processing", each one side printed printing paper sheet is fed from the inverting section 26 of the circulating conveyance path 24 during a period corresponding to the paper feeding time Tp between the printing paper sheets fed from the paper feeding section 23 (for example, between the first printing paper sheet and the second printing paper sheet), similarly to the case of the printing condition of "duplex printing without post-processing". That is, the circulating conveyance path 24 is controlled based on the paper spacing interval Tg' to feed the one side printed printing paper sheets at the above-described paper feeding timing.

Therefore, the paper feeding timing setting section 29 calculates the paper spacing interval Tg' that satisfies Tf=2×(Tp+Tg'), and sets the paper feeding timing from the inverting section 26 of the circulating conveyance path 24 based on the paper spacing interval Tg'.

Next, the paper feed control in the case of the printing condition of "duplex printing with post-processing" where the post-processing times for the individual printing paper sheets are different is described.

Figure 7:
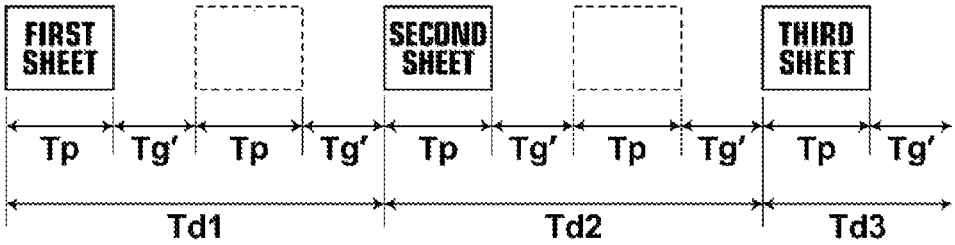
FIG. 7 is a diagram for explaining paper feed control in a case of a printing condition of "duplex printing with post-processing", where post-processing times for individual printed printing paper sheets are different.

Also in this case, the printing paper sheets are fed from the paper feeding section 23, and each one side printed printing paper sheet is fed from the inverting section 26 of the circulating conveyance path 24 during a period corresponding to the paper feeding time Tp between the printing paper sheets fed from the paper feeding section 23, as shown in FIG. 7. However, a different method from that used in the above-described case where the post-processing times for the individual printing paper sheets are the same is used to calculate paper feeding intervals Td1 to Td3 and the paper spacing interval Tg' for the printing paper sheets fed from the paper feeding section 23.

Specifically, for m printing paper sheets, different post-processing times Tf1 to Tfm are read out from the post-processing time storing section 32 of the post-processing unit 30 and outputted to the printing unit 20 to be obtained by the post-processing time obtaining section 28 of the printing unit 20. Then, the post-processing times Tf1 to Tfm obtained by the post-processing time obtaining section 28 are inputted to the paper feeding timing setting section 29, where Tg'i that satisfies Tfi=2×(Tp+Tg'i), i=1 to m, is calculated, similarly to the above-described case where the post-processing times for the individual printing paper sheets are the same. Specifically, for example, Tg'1 that satisfies Tf1=2×(Tp+Tg'1) is calculated, Tg'2 that satisfies Tf2=2×(Tp+Tg'2) is calculated, and so forth, to calculate m paper spacing intervals Tg'1 to Tg'm.

Then, for each paper spacing interval Tg'i (i=1 to m), the paper feeding timing setting section 29 calculates the expression below:

$$\Sigma(nj\times 2\times(Tp+Tg'i)-Tfj),\ j=1 \text{ to } m,$$

where nj is a minimum integer that satisfies nj×2×(Tp+Tg'i) ≥Tfj, and Σ is a cumulative addition of the cases where j=1 to m.

Specifically, the above expression is calculated for each of Tg'1 to Tg'm as shown below to find m cumulative addition values V1 to Vm:

$$\Sigma(nj\times 2\times(Tp+Tg'1)-Tfj),\ j=1 \text{ to } m,$$

$$\Sigma(nj\times 2\times(Tp+Tg'2)-Tfj),\ j=1 \text{ to } m,$$

$$\Sigma(nj\times 2\times(Tp+Tg'3)-Tfj),\ j=1 \text{ to } m,$$

$$\Sigma(nj\times 2\times(Tp+Tg'm)-Tfj),\ j=1 \text{ to } m.$$

Then, from the thus calculated m cumulative addition values V1 to Vm, the smallest cumulative addition value is selected, and Tg'i for which the selected cumulative addition value is calculated is set as the final paper spacing interval Tg'.

Then, the paper feeding timing setting section 29 sets the paper feeding intervals Td1 to Tdm for the individual printing paper sheets fed from the paper feeding section 23 by calculating:

$$nj\times 2\times(Tp+Tg'),\ j=1 \text{ to } m,$$

where nj is a minimum integer that satisfies nj×2×(Tp+Tg') ≥Tfj, j=1 to m.

Specifically, for example, the paper feeding interval Td1 is set by calculating n1×2×(Tp+Tg'), where n1 is a minimum integer that satisfies n1×2×(Tp+Tg')≥Tf1. The paper feeding interval Td2 is set by calculating n2×2×(Tp+Tg'), where n2 is a minimum integer that satisfies n2×2×(Tp+Tg')≥Tf2. The paper feeding interval Td3 is set by calculating n3×2×(Tp+Tg'), where n3 is a minimum integer that satisfies n3×2×(Tp+Tg')≥Tf3.

The paper feeding timing setting section 29 sets the thus calculated paper feeding intervals Td1 to Tdm as the paper feeding timing for the individual printing paper sheets fed from the paper feeding section 23, and sets the paper feeding timing from the inverting section 26 of the circulating conveyance path 24 based on the finally calculated paper spacing interval Tg'.

According to the printing system 1 of the above-described embodiment, a post-processing time taken for the post-processing performed by the post-processing unit on each duplex printed printing paper sheet is obtained, and the paper feeding interval Td for the printing paper sheets fed from the paper feeding section 23 is set based on the obtained post-processing time for each duplex printed printing paper sheet. Further, based on the obtained post-processing time for each duplex printed printing paper sheet, the paper spacing interval Tg' between each printing paper sheet fed from the paper feeding section 23 and each one side printed printing paper sheet is calculated, and the paper feeding timing for the one side printed printing paper sheets is set based on the paper spacing interval Tg'. This allows optimizing the paper spacing interval Tg' between each printing paper sheet fed from the paper feeding section 23 and each one side printed printing paper sheet when compared to the above-described method where the paper feeding interval is changed into an integer multiple of the paper feeding interval Tb based on the post-processing time, as shown in FIG. 4, and the productivity can be improved.

Further, in the case where the printing system 1 of the above-described embodiment is adapted to, when the post-processing times for the individual duplex printed printing paper sheets are different from one another, calculate the paper spacing intervals Tg'1 to Tg'm corresponding to the post-processing times Tf1 to Tfm based on the post-processing times Tf1 to Tfm different from one another, select, from the calculated paper spacing intervals Tg'1 to Tg'm, the paper spacing interval that results in a minimum sum of differences between each of the paper feeding intervals (nj×2×(Tp+Tg'i), j=1 to m) calculated using each paper spacing interval and the post-processing time Tfj (j=1 to m) corresponding to the paper feeding interval, and set, based on the selected paper spacing interval Tg, the paper feeding timing of the printing paper sheets fed from the paper feeding section 23 and the one side printed printing paper sheets, a more optimal paper spacing interval can be selected for the different post-processing times for the individual duplex printed printing paper sheets, and the productivity can further be improved.

Next, a specific example and the effect of setting the paper spacing interval Tg' and the paper feeding interval Td using the method of the above-described embodiment are described with respect to the case of the printing condition of "duplex printing with post-processing" where the post-processing times for the individual printing paper sheets are different. In this example, stapling is performed as the post-processing.

Figure 8:
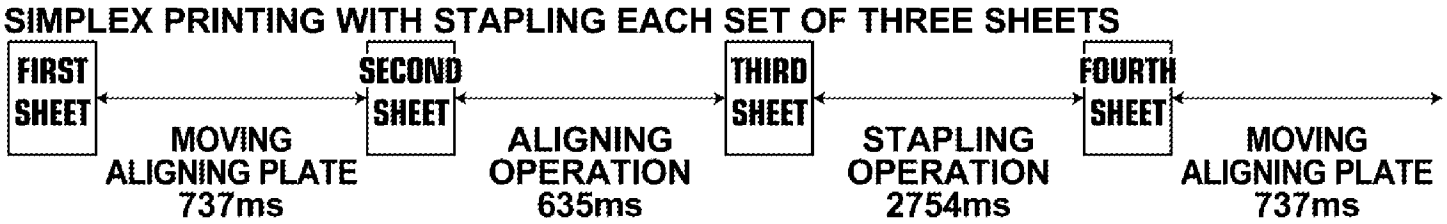
FIG. 8 is a diagram for explaining an operation performed for each printed printing paper sheet in a case where stapling is performed on each set of three printed printing paper sheets during simplex printing.

First, the post-processing performed on the printed printing paper sheets to achieve stapling is described with respect to the case of simplex printing, as an example. For example, in a case where stapling is performed on each set of three simplex printed printing paper sheets, as shown in FIG. 8, a moving operation to move an aligning plate is performed when the first printing paper sheet is fed and received by the post-processing unit 30, an aligning operation to align the printed printing paper sheets is performed when the second printing paper sheet is fed and received by the post-processing unit 30, and a stapling operation is performed when the third printing paper sheet is fed and received by the post-processing unit 30. The post-processing times of the post-processing for the individual printing paper sheets are different. Specifically, the post-processing time for the first printed printing paper sheet is a time taken for the moving operation to move the aligning plate, which is 737 ms. The post-processing time for the second printed printing paper sheet is a time taken for the aligning operation to align the printed printing paper sheets, which is 635 ms. The post-processing time for the third printed printing paper sheet is a time taken for the stapling operation to staple the printed printing paper sheets, which is 2754 ms.

Figure 9:
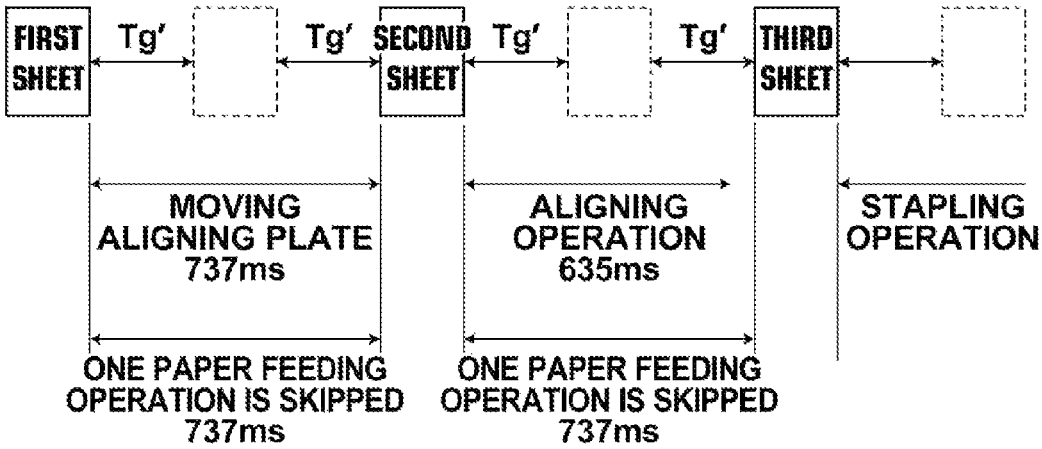
FIG. 9 is a diagram for explaining a specific example of a case where a paper feeding interval and a paper spacing interval are set using one embodiment of the invention.

Assuming that the above-described operations of the stapling in the case of simplex printing are also performed in the case of duplex printing, then, when the paper spacing interval Tg' and the paper feeding interval Td are set using the method of the above-described embodiment, the paper feed control is exerted at the paper feeding timing as shown in FIG. 9. For simplicity's sake, only the time taken for the moving operation to move the aligning plate and the time taken for the aligning operation to align the printed printing paper sheets are focused as the post-processing times for the individual printed printing paper sheets in this explanation.

Specifically, assuming that the post-processing time for the first printed printing paper sheet is 737 ms that is the time taken for the moving operation to move the aligning plate, the post-processing time for the second printed printing paper sheet is 635 ms that is the time taken for the aligning operation, and the paper feeding time Tp=332 ms, then the paper spacing interval Tg' is calculated by Tg'=(737 ms−332 ms)/2 and the paper feeding interval between the first printing paper sheet and the second printing paper sheet is 737 ms according to the paper feed control method of the above-described embodiment. Also, the paper feeding interval between the second printing paper sheet and the third printing paper sheet is 737 ms. That is, one paper feeding operation is skipped between the first and second printing paper sheets and between the second and third printing paper sheets.

Figure 10:
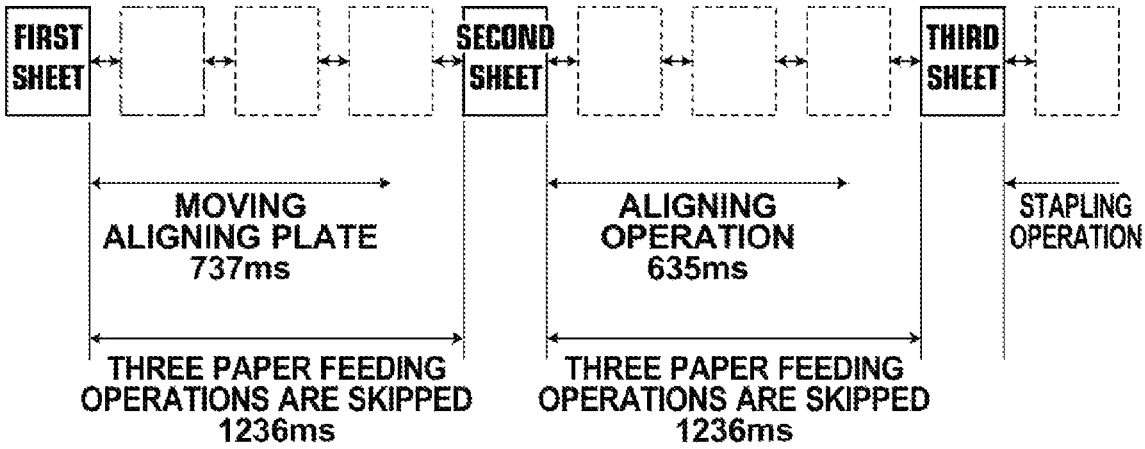
FIG. 10 is a diagram for explaining a specific example of a case where a paper feeding interval between printing paper sheets is changed into an integer multiple of the paper feeding interval calculated by 2×(Tp (paper feeding time)+Tg (standard paper spacing interval))

In contrast, in the case where the paper feeding interval of the printing paper sheets is changed into an integer multiple of the paper feeding interval calculated by 2×(Tp (paper feeding time)+Tg (standard paper spacing interval)) and the standard paper spacing interval is 60 ms, for example, the paper feeding interval between the first printing paper sheet and the second printing paper sheet is 1236 ms, as shown in FIG. 10. That is, three feeding operations are skipped between the first and second printing paper sheets. In other words, two extra feeding operations are skipped when compared to the case of this embodiment shown in FIG. 9.

Therefore, according to the paper feed control method of this embodiment, the number of paper feeding operations to be skipped can be reduced, thereby improving the productivity.

Figure 11:
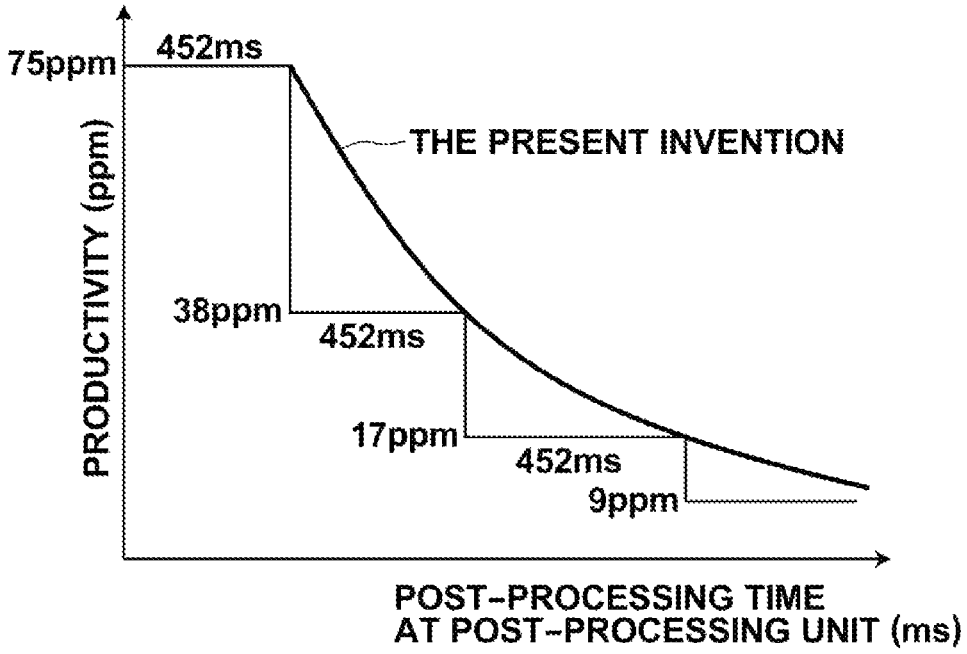
FIG. 11 is a diagram illustrating change of productivity relative to a post-processing time in the case where the paper feeding interval and the paper spacing interval are set using one embodiment of the invention, and change of productivity relative to the post-processing time in the case where a paper feeding interval between printing paper sheets is changed into an integer multiple of the paper feeding interval calculated by 2×(Tp (paper feeding time)+Tg (standard paper spacing interval))
Figure 12:
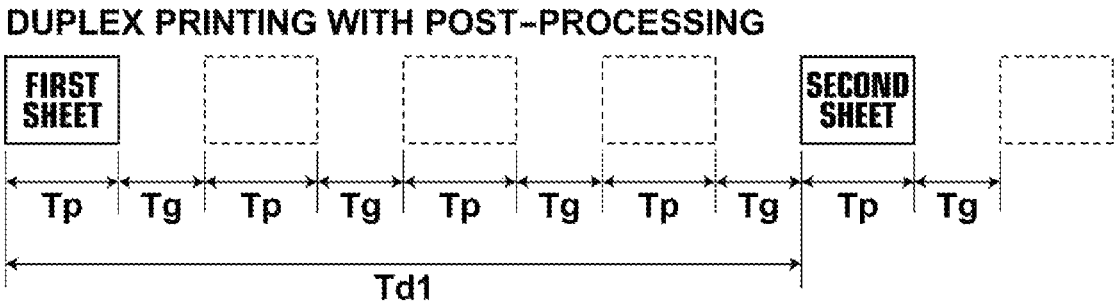
FIG. 12 is a diagram for explaining the case where the paper feeding interval between printing paper sheets is changed into an integer multiple of the paper feeding interval calculated by 2×(Tp (paper feeding time)+Tg (standard paper spacing interval)).

FIG. 11 is a diagram showing the productivity in the case where the paper feeding interval of the printing paper sheets is changed into an integer multiple of the paper feeding interval calculated by 2×(Tp (paper feeding time)+Tg (standard paper spacing interval)) depending on the post-processing time for the individual printed printing paper sheets, as shown in FIG. 10, and the productivity in the case where the paper feeding interval and the paper spacing interval are controlled according to the method of the invention. It should be noted that FIG. 11 is a graph showing the relationship between the post-processing time and the productivity of each case where the post-processing times for the individual printed printing paper sheets are the same.

As shown in FIG. 11, in the case where the paper feeding interval of the printing paper sheets is changed into an integer multiple of the paper feeding interval calculated by 2×(Tp (paper feeding time)+Tg (standard paper spacing interval)), the productivity is improved only when the post-processing time is equal to Tp (332 ms)+2Tg (60 ms)=452 ms, resulting in a graph showing stepwise improvement. In contrast, according to the invention, the paper feeding interval and the paper spacing interval are linearly changed depending on the post-processing time, and the change of the productivity relative to the post-processing time is also linear, resulting in higher productivity.

It should be noted that, although the post-processing time of the post-processing at the post-processing unit 30 is stored in advance in the post-processing time storing section 32 in the printing system 1 of the above-described embodiment, this is not intended to limit the invention. For example, the post-processing time may be calculated based on a speed and an operation time of an actuator of a mechanism for performing the post-processing. The speed and the operation time of the actuator may be stored in advance or may be actually measured during an initialization operation of the post-processing unit 30, which is performed before the paper feeding from the printing unit 20 is started.

What is claimed is:

1. A printing apparatus comprising:

a paper feeding section for feeding printing paper sheets one by one;

a printing section for performing duplex printing by performing printing on one side of each printing paper sheet fed by the paper feeding section, and, after the one side printed printing paper sheet is inverted by an inverting section, performing printing on the other side of the inverted one side printed printing paper sheet;

a control section for:

controlling the paper feeding section and the printing section such that, when the printing section performs the duplex printing, the printing on the one side of each printing paper sheet fed from the paper feeding section and the printing on the other side of each one side printed printing paper sheet are alternately performed, setting a time corresponding to a paper spacing interval prior to and following paper feeding times of the printing paper sheets within a paper feeding interval between the feeding times of the printing paper sheets from the paper feeding section, and controlling the paper feeding section such that the one side printed printing paper sheet is fed to the printing section between the paper feeding times;

a post-processing time obtaining section for obtaining a post-processing time for each duplex printed printing paper sheet taken for post-processing to be performed on the duplex printed printing paper sheets at a post-processing unit connected downstream the printing section; and a paper feeding timing setting section for setting a paper feeding interval of the printing paper sheets fed from the paper feeding section based on the post-processing time for each duplex printed printing paper sheet obtained by the post-processing time obtaining section, and setting paper feeding timing of the one side printed printing paper sheets based on an amount of time corresponding to the paper spacing interval between each printing paper sheet fed from the paper feeding section and each one side printed printing paper sheet, the amount of time corresponding to the paper spacing interval being calculated based on the post-processing time for each duplex printed printing paper sheet.

2. The printing apparatus as claimed in claim 1, wherein, if at least two of the post-processing times for the individual duplex printed printing paper sheets obtained by the post-processing time obtaining section are different from one another, the paper feeding timing setting section calculates the amount of time corresponding to the paper spacing interval corresponding to each post-processing time based on the post-processing times different from one another, selects, from the calculated amount of time corresponding to the paper spacing intervals, the amount of time corresponding to the paper spacing interval that results in a minimum sum of differences between each of the paper feeding intervals calculated using each amount of time corresponding to the paper spacing interval and the post-processing time corresponding to the paper feeding interval, and sets the paper feeding timing of the printing paper sheets fed from the paper feeding section and the one side printed printing paper sheets based on the selected amount of time corresponding to the paper spacing interval.

3. The printing apparatus as claimed in claim 1, wherein, if all the post-processing times for the individual duplex printed printing paper sheets obtained by the post-processing time obtaining section are the same, the paper feeding timing setting section sets the post-processing time as the paper feeding interval of the printing paper sheets fed from the paper feeding section, and sets the amount of time corresponding to the paper spacing interval based on the post-processing time.

4. The printing apparatus as claimed in claim 1, wherein the post-processing time obtaining section obtains the post-processing time that is stored in advance in the post-processing unit.

* * * * *